United States Patent [19]

Tillery

[11] Patent Number: 4,541,632

[45] Date of Patent: Sep. 17, 1985

[54] GOLF BALL TEEING APPARATUS

[76] Inventor: Thomas H. Tillery, 3791 Catalina St., Los Alamitos, Calif. 90720

[21] Appl. No.: 605,935

[22] Filed: May 1, 1984

[51] Int. Cl.[4] ..... A63B 57/00

[52] U.S. Cl. ..... 273/201

[58] Field of Search ..... 273/201, 33, 35 A, 35 B, 273/182 R, 182 A, 181, 184 R, 184 A, 176 A, 195 R, 195 B

[56] References Cited

U.S. PATENT DOCUMENTS

| | | | |
|---|---|---|---|
| 1,637,537 | 8/1927 | Roberts | 237/182 R |
| 1,935,291 | 11/1933 | Gardner et al. | 273/33 |
| 2,061,973 | 11/1936 | Loeb | 273/35 |
| 2,331,237 | 10/1943 | Schaefer | 273/35 |
| 2,379,663 | 7/1945 | Smith | 273/35 |
| 2,458,105 | 1/1949 | Sell | 273/35 |
| 2,609,199 | 9/1952 | Koener | 273/35 |
| 2,838,313 | 6/1958 | Mozel | 273/201 |
| 3,037,776 | 6/1962 | Younce | 273/182 |
| 3,260,527 | 7/1966 | Younce | 273/176 |
| 3,411,788 | 11/1968 | Blanding | 273/176 |
| 3,523,689 | 8/1970 | Cornell et al. | 273/176 |
| 3,591,184 | 7/1971 | Conklin et al. | 273/176 |
| 3,599,983 | 8/1971 | Melton | 221/289 |
| 3,602,506 | 8/1971 | Gentiluomo | 273/176 |
| 3,620,536 | 11/1971 | Lau | 273/176 |
| 3,687,457 | 8/1972 | Mason et al. | 273/176 |
| 3,756,606 | 9/1973 | Land | 273/201 |
| 3,778,067 | 12/1973 | Gentiluomo | 273/33 |
| 3,826,501 | 7/1974 | Hiromachi | 273/176 |
| 3,861,680 | 1/1975 | Mowrer | 273/176 |
| 3,897,947 | 8/1975 | Heffley, Jr. | 273/176 |
| 3,910,583 | 10/1975 | Appel | 273/182 |
| 3,966,213 | 6/1976 | Bradley | 273/201 |
| 4,017,087 | 4/1977 | Bruno | 273/201 |
| 4,167,266 | 9/1979 | Tabicman | 273/182 |
| 4,171,812 | 10/1979 | Marsin | 273/184 |
| 4,198,054 | 4/1980 | Stone | 273/201 |
| 4,215,865 | 8/1980 | Pilati | 273/182 |
| 4,336,939 | 6/1982 | Krumlauf | 273/181 |

*Primary Examiner*—Richard C. Pinkham
*Assistant Examiner*—T. Brown
*Attorney, Agent, or Firm*—Fulwider, Patton, Rieber, Lee & Utecht

[57] ABSTRACT

Golf ball teeing apparatus including elements actuable for sequentially gripping and transporting a ball from a loading station to a hitting station, and for releasing the ball at the hitting station prior to return movement of the elements to the loading station. The interaction of the elements is such that movement of the elements between the loading and hitting stations is not possible prior to such gripping or releasing. The apparatus is adapted to adjust the placement of the ball to suit the location of the hitting station for wood shots or iron shots, as desired.

20 Claims, 18 Drawing Figures

FIG. 1
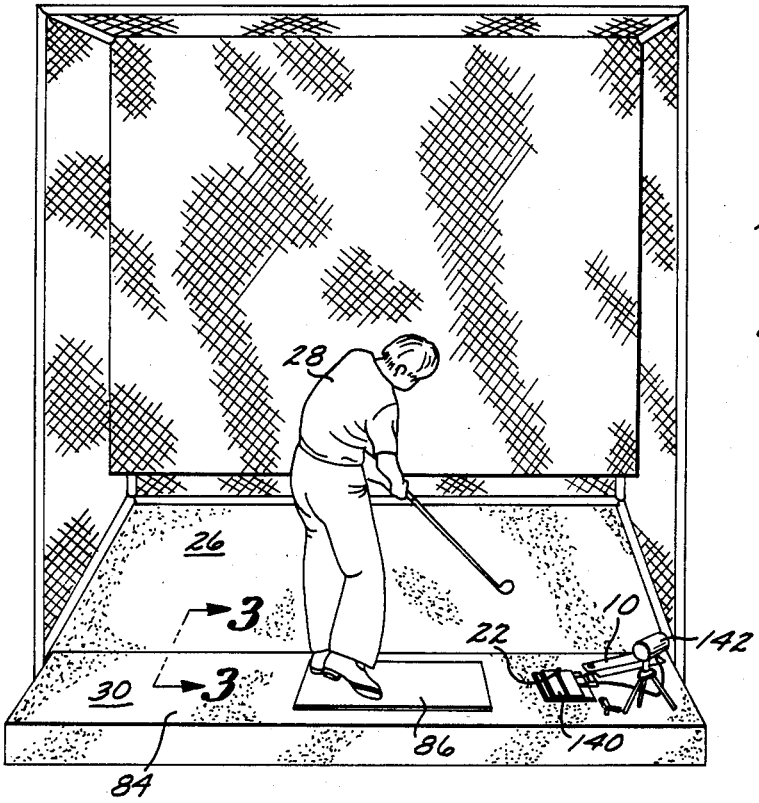
FIG. 2
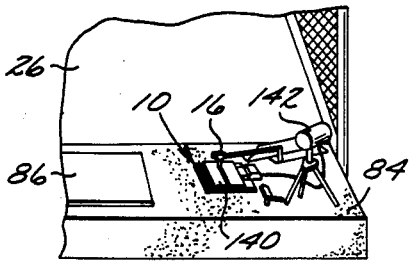
FIG. 3
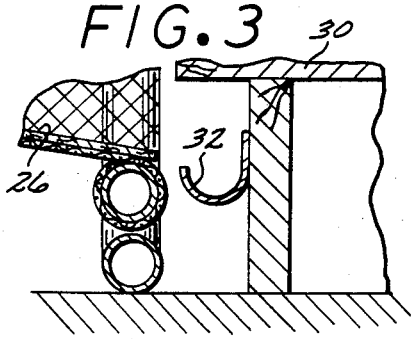
FIG. 4
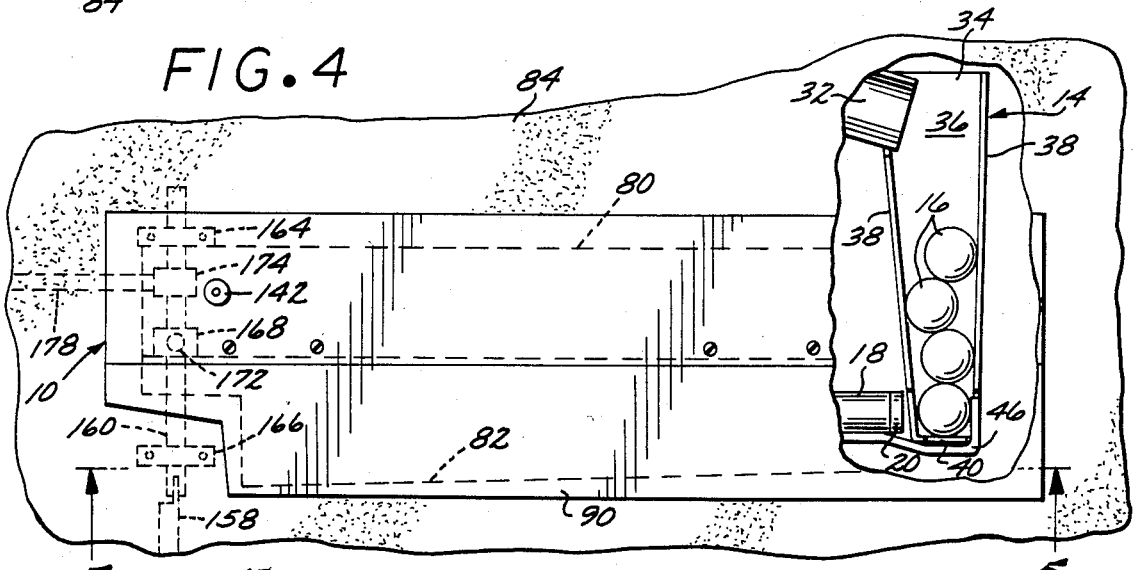
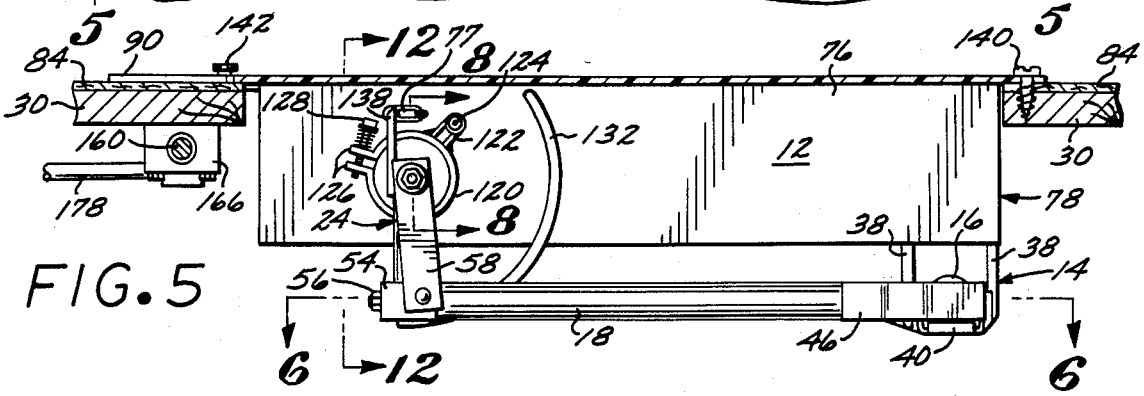
FIG. 5

FIG. 6
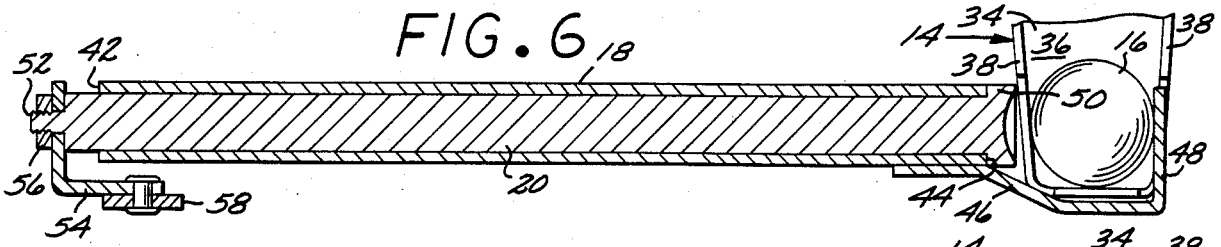
FIG. 7
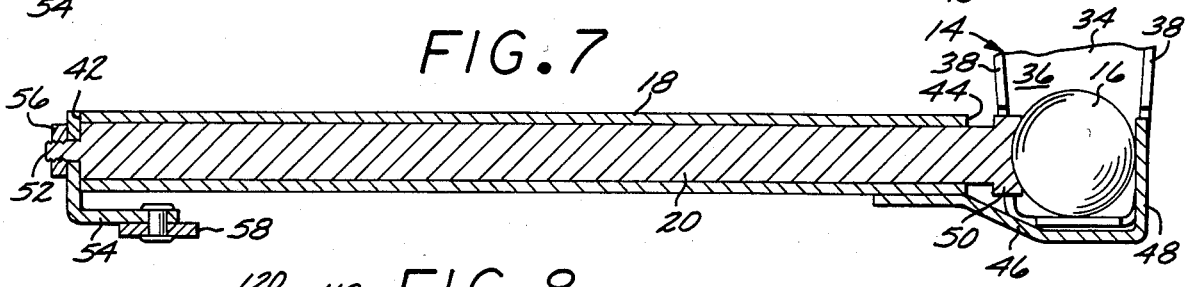
FIG. 8
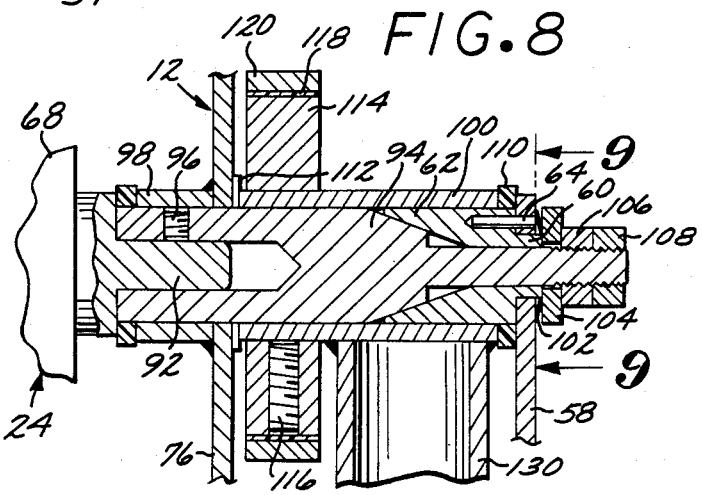
FIG. 9
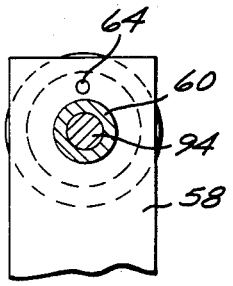
FIG. 10
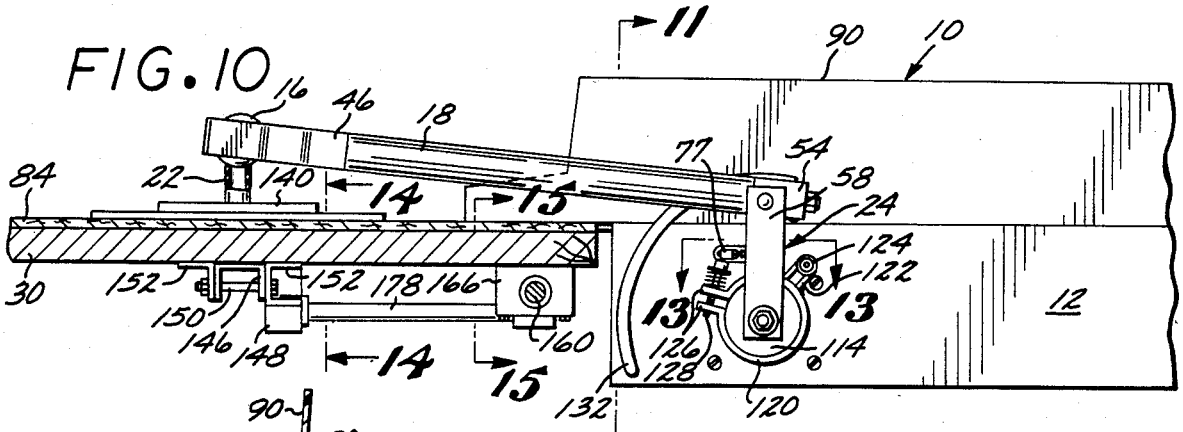
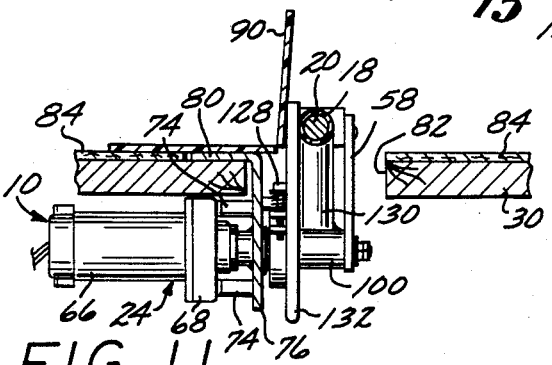
FIG. 11
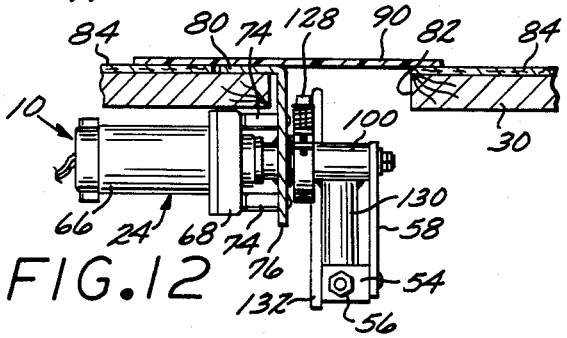
FIG. 12

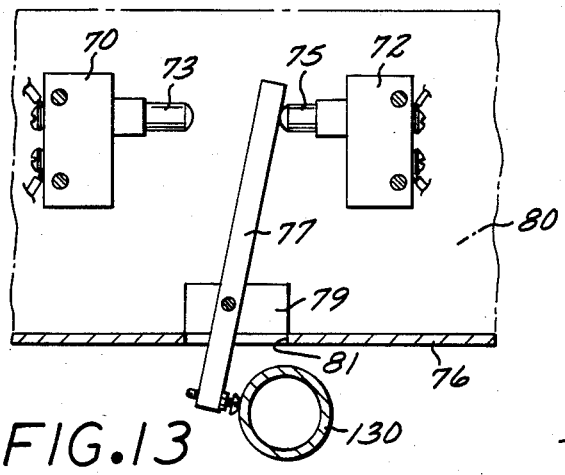
FIG.13
FIG.14
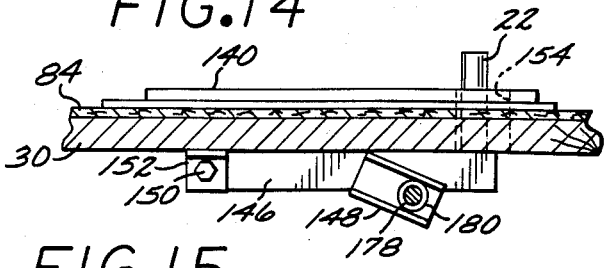
FIG.15
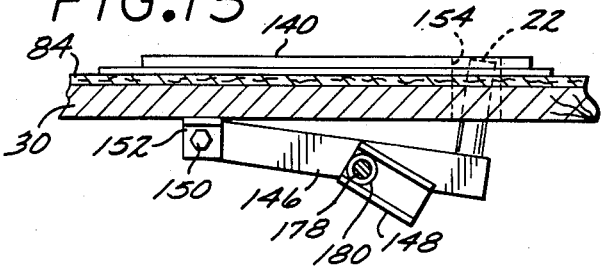
FIG.16
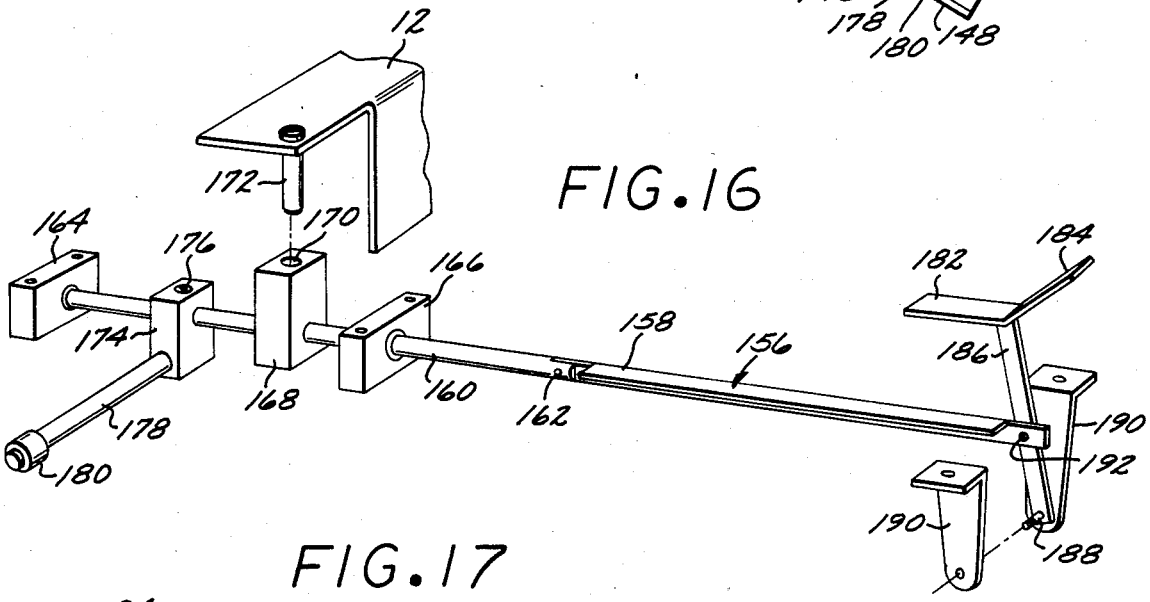
FIG.17
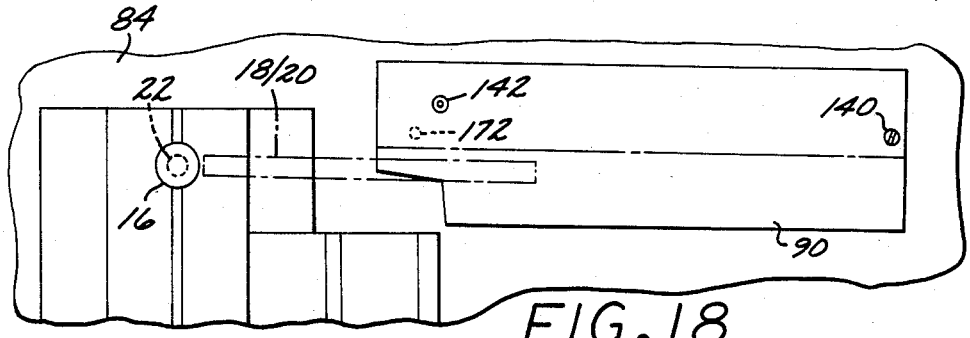
FIG.18
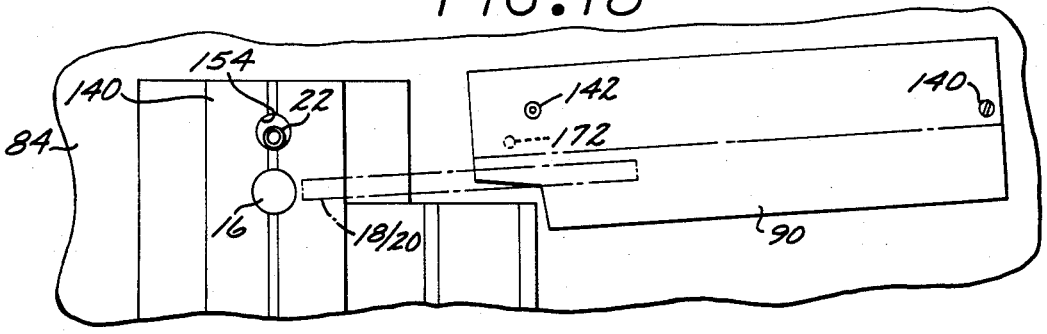

GOLF BALL TEEING APPARATUS

BACKGROUND OF THE INVENTION

1. Field of the Invention:

The present invention relates to golf ball teeing apparatus, and more particularly to such an apparatus operative automatically to move a golf ball to a hitting station at the touch of a switch.

2. Description of the Prior Art:

Golf driving ranges are widely used by golfers in practicing their game. Typically such ranges are out of doors and not usable in inclement weather. Further, the golfer is usually required to manually place or tee up each ball to be hit. Since golf is a game requiring considerable concentration, it is distracting to a golfer, having analyzed his last shot, to have to interrupt his concentration by bending over and teeing up a fresh ball.

Indoor driving ranges are designed to allow the golfer to practice in a protected environment, but analysis of the effectiveness of each shot is difficult because of the necessarily short flight of the ball. Such ranges sometimes provide automatic teeing devices, but such devices are generally unsatisfactory because of their high cost, complexity, short service life, or lack of reliability.

SUMMARY OF THE INVENTION

According to the present invention, a golf ball teeing apparatus is provided which is ideally suited for use in an indoor golf driving range, and particularly in association with recently developed devices which provide a computerized display. A special tee and base react to the impact of the club head against the golf ball and trigger a display of the probable distance the ball would have traveled and whether it was hooked or sliced.

The golf ball teeing apparatus comprises a ball receptacle for receiving golf balls traveling under gravity from a suitable backdrop. Elongated carrier and gripper members are coupled together so as to enable longitudinal movement of the gripper member relative to the carrier member. Drive means first move the gripper member relative to the carrier member to grip a ball in a loading station, and then pivot both the carrier and gripper members to a hitting station. At that point the gripper member is moved relative to the carrier member to release the ball, and the drive means next pivots the members back to the loading station. Thus, the ball is gripped or released prior to any pivotal movement of the members between the hitting and loading stations.

In one embodiment the frame of the apparatus is pivotally mounted at one extremity, and is pivotally supported at its opposite extremity by a frame actuating means. Foot operation of the frame actuating means moves the frame between a woods position, in which the carrier and gripper members are oriented to deposit the ball on the tee, and an irons position in whch the members are oriented to deposit the ball behind the tee. Tee mounting means support the tee and are cooperative with the frame actuating means to pivot the tee to a projected position when the frame is moved into its woods position; and to pivot the tee to a retracted position when the frame is moved into its iron position.

Other objects and features of the invention will become apparent from consideration of the following description taken in connection with the accompanying drawings.

BRIEF DESCRIPTION OF THE DRAWINGS

FIG. 1 is a front elevational view of the golf ball teeing apparatus in association with a golf stroke analyzer, the carrier and gripper members being illustrated in the loading station;

FIG. 2 is a detail view of the apparatus of FIG. 1, but illustrating the carrier and gripper members in the hitting station;

FIG. 3 is an enlarged view taken along the line 3—3 of FIG. 1;

FIG. 4 is an enlarged top plan view of the hitting apparatus, a portion of the apparatus and adjacent platform being cut away to illustrate the ball receptacle;

FIG. 5 is a view taken along the line 5—5 of FIG. 4, illustrating the carrier and gripper members in the loading station;

FIG. 6 is a view taken along the line 6—6 of FIG. 5, illustrating the release position of the gripper member;

FIG. 7 is a view similar to FIG. 6, illustrating the gripping position of the gripper member;

FIG. 8 is an enlarged view taken along the line 8—8 of FIG. 5;

FIG. 9 is a view taken along the line 9—9 of FIG. 8;

FIG. 10 is a view similar to FIG. 5, illustrating the carrier and gripper members in the teeing station;

FIG. 11 is a view taken along th line 11—11 of FIG. 10;

FIG. 12 is a view similar to FIG. 11, but illustrating the carrier and gripper members in the loading station;

FIG. 13 is a view taken along the line 13—13 of FIG. 10;

FIG. 14 is a view taken along the line 14—14 of FIG. 10;

FIG. 15 is a view taken along the line 15—15 of FIG. 10;

FIG. 16 is a perspective, exploded view of the tee and ball locator mechanism;

FIG. 17 is a partial top plan view of the hitting apparatus, including the tee and ball locator mechanism, in its forward or "woods" position; and FIG. 18 is a view siilar to FIG. 17, but illustrating the apparatus in its rearward or "irons" position.

DETAILED DESCRIPTION OF THE PREFERRED EMBODIMENT

Referring now to the drawings, there is illustrated a golf teeing apparatus 10 according to the present invention which comprises, generally, a frame 12; a ball receptacle 14 adjacent the frame 12 and defining a loading station for receiving a ball 16; an elongated carrier member 18 and an elongated gripper member 20 coupled together for pivotal movement between the loading station and a hitting station adjacent a tee 22; and drive means 24 mounted to the frame 12 and operative to pivot the members 18 and 20 between the loading and hitting stations.

The apparatus 10 is illustrated in FIG. 1 in association with an enclosure defining an indoor driving range. The enclosure includes a top wall, side walls, and a back wall formed by flexible netting or mesh material mounted to tubular frame members. However, the enclosure could be formed by any suitable structure adapted to absorb the impact of a golf ball and drop it onto a floor 26 sloping downwardly toward the golfer 28.

As best seen in FIGS. 2 and 3, the golfer stands upon a platform 30 located above the rearward edge of the floor 26 so that golf balls rolling under the force of gravity along the floor 26 drop off the floor 26 and into a laterally oriented hopper 32 which slopes laterally and downwardly toward the ball receptacle 14. As seen in FIG. 4, golf balls rolling along the hopper 32 under gravity will drop from the end of the hopper 32 onto the base 34 of a tray 36 which forms part of the ball receptacle 14. The base 34 slopes rearwardly and downwardly in the direction of the golfer, and its side edges are upturned to form opposite side walls 38 which converge rearwardly to guide golf balls into the rearward extremity of the tray 36.

The outer or forward portion of the side wall 38 adjacent the hopper 32 is cut away to accept the extremity of the hopper 32 and facilitate movement of golf balls from the hopper 32 onto the base 34 of the tray 36. In addition, the rearward extremities of the side walls 38 are cut away for a purpose which will become apparent. The tray 36 also includes an upturned inner end which defines an inner wall or stop 40 to limit rearward travel of the golf ball and thereby define a loading station.

The carrier member 18 comprises a tubular sleeve having an inner or pivot end which defines a gripping stop 42, and an outer or free end which defines a release stop 44. The carrier member 18 also includes an end member 46 which is fixed to the outer extremity of the tubular sleeve. In the loading station of the carrier member 18 illustrated in FIGS. 6 and 7, the end member 46 extends beyond the tubular sleeve and behind the stop 40. The projecting end of member 46 terminates in a forwardly extending leg or abutment 48 which is located on the side of the loading station opposite the tubular sleeve of the carrier member 18, where it constitutes a temporary side wall for the receptacle 14.

The gripper member 20 comprises a cylindrical rod which is longitudinally slidably carried within the carrier member 18. The outer or free extremity of the gripper member 20 includes an enlarged ball engaging head 50 having a concave cavity adapted to closely engage the curved surface of the ball 16.

As seen in FIG. 6, shoulders on the head 50 are engageable upon the release stop 44 to define a release position of the gripper member 20.

The inner or pivot end of the gripper member 20 includes a reduced diameter threaded shank 52. One leg of a right angle bracket 54 is fixed in position on the shank 52 by a nut 56. The other leg is pivotally mounted to the lower extremity of an elongated drive arm 58. The upper extremity of the drive arm 58 includes an opening which receives a reduced diameter portion 60 of a cylindrical driven clutch member 62, as best seen in FIG. 8. A pin 64 extends through the drive arm 58 and the driven clutch member 62 to prevent relative pivotal movement between them.

The drive arm 58 is a part of the drive means 24, which also includes a usual and conventional electrically energizable drive motor 66. The motor 66 is reversible for rotation in opposite directions upon operation of limit switches 70 and 72, respectively, as best seen in FIGS. 5, 10 and 13. The switches are fixed to the underside of the horizontal wall 80 with their actuator or switch pins 73 and 75 in confronting relation. A switch actuator level 77 is pivotally carried by a plate 79 supported by the wall 80, and the inner or forward extremity of this lever 77 extends between the pins 73 and 75. The other extremity of the lever 77 projects through an opening 81 in the vertical wall 76 and mounts machine screws which are engageable to actuate the limit switches 70 and 72, as will be described in greater detail hereinafter.

The rate of rotation of the drive motor 66 is reduced by coupling its drive shaft to a usual gear box 68 which is fixed by a plurality of mounts 74 to the vertical leg or wall 76 of a horizontally elongated right angular mounting bracket 78. The bracket 78 constitutes the main part of the frame 12, as best seen in FIGS. 11 and 12.

The upper extremity of wall 76 extends through a laterally extending opening or slot 82 provided in the platform 30. The wall 76 is close to the forward edge of the slot 82 to allow room for the carrier and gripper members 18 and 20 to pivot through the slot 82 during their travel between the loading station of FIG. 12 and the hitting station of FIG. 11.

The horizontal leg or wall 80 of the mounting bracket 78 overlies the golfer's platform 30 adjacent the slot 82, and abuts against an edge of suitable material such as indoor-outdoor carpeting 84. Carpeting 84 covers most of the platform 30 except for the opening or slot 82. In addition, a rectangular mat 86 is provided for the golfer to stand on for better traction. The carpeting 84 extends up to the rearward edge of the slot 82, forming a cushioned stop upon which one edge of an elongated, movable flap 90 is adapted to rest. The flap 90 is part of a generally rectangular sheet of plastic material characterized by a central hinge or bend line. The portion of the sheet opposite the flap 90 is suitably attached, as by rivets or the like, to the horizontal wall 80, and is freely slidable over the carpeting 84. Although other hinge arrangements could be provided, the plastic material is adopted to be repeatedly flexed at its hinge line, providing what is popularly known as a "living hinge", and affording an aesthetically pleasing covering for the slot 82.

A drive shaft 92 of the gear box 68 extends into a bore of a cylindrical clutch drive member 94. It is constrained against relative rotation by a lock screw 96 which is threaded through the clutch drive member 94 and bears against the gear box drive shaft 92.

The drive member 94 is rotatably carried by a cylindrical sleeve or bearing 98 welded to the wall 76, as best seen in FIG. 8, and extends through the wall 76, through a cylindrical coupling sleeve 100, and into a driven clutch member 62 connected to the drive arm 58. The sleeve 100 rotatably supports both the drive member 94 and the driven member 62.

The friction coupling of the members 94 and 62 is afforded by a conical portion of the member 94 fitting into a complemental conical cavity formed in the drive clutch member 62. Rotation of the clutch drive member 94 correspondingly rotates the driven clutch member 62 up to a predetermined maximum torque level, at which point drive clutch member 62 slips and is not rotated. As will be seen, this protects apparatus 10 against damage should torque continue to be applied to the carrier and gripper members 18 and 20 after they have reached their loading or teeing positions, as the case may be.

The free extremity of clutch drive member 94 is threaded, as best seen in FIG. 8, to receive a compression or Belleville washer 102, a bearing washer 104, a nut 106, and a lock nut 108. The degree of tightening of the nuts 106 and 108 establishes the level of frictional engagement between the complemental conical faces of the members 94 and 62 and thereby establishs the level of torque at which slippage occurs.

Tightening of the nuts 106 and 108 also causes drive arm 58 to frictionally bear against a thrust washer 110.

The washer 110 engages the adjacent extremity of coupling sleeve 100, forcing the opposite extremity of the coupling sleeve 100 to bear against a spacing washer 112 which is engaged upon the face of the frame vertical wall 76. This frictional coupling tends to cause rotation of coupling sleeve 100 upon pivotal movement of the drive arm 58.

An alternative arrangement (not shown) for pivotal movement of the drive arm 58 and crank arm 130 by the drive shaft 92 is to make the drive member 94 and driven member 62 integral, fixedly connecting the resulting integral member to the drive shaft 92, and providing bearings in the drive means 24 to support the weight of the integral member, rather than utilizing the bearing 98 and frame 12 for such support. The provision of such an integral member simpolifies the construction and reduces the cost, and is a practical alternative where the clutch arrangement provided by the members 62 and 94 is unnecessary.

The tendency of the coupling sleeve 100 to pivot with drive arm 58 is resisted by a friction or drag assembly comprising a disk 114 secured by a set screw 116 to the coupling sleeve 100 for common rotation, a friction pad or lining 118 disposed about the circumference of the disk 114, and an encircling ring 120. Ring 120 is engaged upon the friction lining 118, and is fixed against rotation by an integral bracket 122 which, as seen in FIG. 5, is attached to the frame vertical wall 76 by a fastener 124. The ring 120 is discontinuous, including a pair of radially outwardly directed opposed legs 126 which are urgable together by friction adjusting means in the form of a bolt 128 threaded through the legs 126. Tightening or loosening the bolt 128 adjusts the degree of frictional constraint upon the coupling sleeve 100. The bolt 128 is adjusted so that rotation of the driven clutch member 62 and drive arm 58 initially occurs, followed by rotation of the coupling sleeve 100 when the applied torque is sufficient to overcome the constraint established by the bolt 128.

The friction sleeve 100 is fixed to one end of a crank arm 130. The opposite extremity of the arm 13 is fixed to the inner or pivot end of the carrier member 18. As a consequence of this arrangement, rotation of the clutch drive member 94 in a counterclockwise direction, as viewed in FIGS. 5 and 10, effects corresponding rotation of the driven clutch member 62 and counterclockwise pivotal movement of the drive arm 58. As seen in FIGS. 6 and 7, gripper member 20 is therefore moved longitudinally from the release position of FIG. 6 to the gripping position of FIG. 7, in which the golf ball 16 is engaged between the gripper member head 50 and the carrier member abutment 48. However, there is no pivotal movement of the carrier member 18 since the crank arm 130 is constrained against pivotal movement by virtue of the frictional resistance imposed by the frictionally interconnected disk 114 and ring 120.

Once gripper member 20 reaches the gripping position, the gripper member bracket 54 engages gripping stop 42 and the full torque of the drive means 24 acts upon carrier member 18. This overcomes the friction developed at the lining 118 and pivots the crank arm 130 and carrier member 18 in a counterclockwise direction. This carries the golf ball 16 in a counterclockwise direction out of the loading position of FIGS. 6 and 7.

One end of an arcuate door or flap actuator 132 is fixed to the carrier member bracket 54, as seen in FIGS. 5, and 10–12, and the opposite or upper end of the actuator 132 is slidably engageable with the underside of the flap 90. As the carrier and gripper members 18 and 20 pivot upwardly in a counterclockwise direction, the actuator 132 on the carrier member bracket 54 engages and pivots the flap 90 to the open position of FIGS. 10 and 11.

Counterclockwise movement of the members 18 and 20 terminates in the hitting position illustrated in FIG. 10, at which point the ball 16 is located on the tee 22, which is made of rubber or similar flexible material. At this point the crank arm 130 engages the switch actuator lever 77 to actuate the switch 72 which by suitable circuitry (not shown) reverses the direction of rotation of the drive motor 66. The members 18 and 20 will now be pivoted in a clockwise direction, but the longitudinal movement of the gripper member 20 from the gripping position of FIG. 7 to the release position of FIG. 6 occurs prior to any pivotal movement of either of the members, in order to release the ball 16 and leave it in place upon the tee 22. More particularly, the drive arm 58 moves the carrier member 18 until its extremity engages the release stop 44, at which point the drive motor torque operates to pivot the members 18 and 20 to the loading position of FIG. 5, with the flap 90 dropping of its own weight, as seen in FIG. 10, to the closed position of FIG. 12. At this point the drive motor is shut off by engagement of the switch actuator lever 77 by a switch arm 138 attached to the drive arm 58 as seen in FIG. 5.

As seen in FIG. 1, the apparatus 10 is preferably angularly directed toward the tee 22, and the tee 22 projects through a base or pedestal 140. Although not shown, electrical sensors are located in the pedestal 140 on the near or player's side of the tee 22. Metal inserts in the golf club head move over these sensors during a golf swing. The sensors are electrically connected to a golf swing analyzer 142 carries on a tripod setting on the platform 30. The analyzer 142 is of any suitable type, such as that which is presently marketed by the Japanese company, Mitsubishi. It includes a visual read out (not shown) which displays to the golfer the probable distance the ball would have been hit, and whether the ball was sliced or hooked, as derived from the impact and direction of the swing of the golfer's club against the ball on the tee 22. This information is derived from the signals generated by virtue of the path followed by the golf club head relative to the platform sensors, as is well known in the art.

Operation of the apparatus 10 is initiated by the golfer tapping a switch 142, as seen in FIGS. 4, 5 and 10, which projects from the frame 12 through the carpeting 84. The switch 142 is suitably connected to the drive motor 66 so that actuation of the switch 142 effects energization of the motor for movement of the gripper member 20 relative the the carrier member 18 to grip a ball 16 in the loading position, followed by counterclockwise rotation of the ball from the loading position to the hitting position. In the hitting position, actuation of the limit switch 72 reverses the direction of rotation of the drive motor 66, which results in movement of the gripper member 20 to release the ball 16 onto the tee 22, followed by clockwise movement of the members 18 and 20 from the hitting position to the loading position of FIG. 5.

The apparatus 10 preferably includes additional mechanisms which are adapted to selectively orient the frame 12 and tee 22 in a different position for iron shots. The tee 22 in the projected position illustrated in FIG. 10, for example, defines the hitting station for wood shots. By providing some means for depositing the golf ball 16 closer to the golfer, and retracting the tee, thereby relocating the hitting station, the same apparatus 10 can be used for practicing with irons.

The angular reorientation of the frame 12 necessary to deposit the ball 16 in one of two selected hitting stations is provided by pivotally supporting the inner end of the frame 12, that is, the end remote from the golfer. Pivotal support is provided, as seen in FIGS. 5, 17 and 18, by a pivot screw 140 extending through the carpeting 84 and into the platform 30. The margins defining the slot 82 into which the frame 12 is fitted are spaced apart sufficiently to enable pivotal movement of the frame 12 upon its pivot screw 144 so that its outer extremity can move through a path long enough to allow the carrier and gripper members 18 and 20 to deposit the ball 16 in either the hitting station or woods positions illustrated in FIGS. 10 and 17, or the hitting station or irons position illustrated in FIG. 18, as will be seen.

As best seen in FIGS. 14 and 15, the tee 22 is carried by a tee mounting means comprising an elongated tee bracket 146 which fixedly carries at its midportion an inclined channel shape cam track 148. The inner extremity of the bracket 146, that is, the extremity nearest the golfer, is pivotally mounted by a transverse pin 150 to a pair of angle brackets 152 (only one of which is illustrated) which are secured to the underside of the platform 30. The platform 30 also includes a vertically oriented opening 154 through which the tee 22 may project, as seen in FIG. 14.

The tee and ball locator mechanism comprising the tee mounting means also comprises a frame actuating means 156 which includes an elongated actuator having a rearward actuator portion 158 of right angular cross section, and a forward actuator portion 160 having a cylindrical section, the portions 158 and 160 being pivotally interconnected at their adjacent extremities by a transverse pin 162. The frame actuating means 156 also includes a pair of bearing blocks 164 and 166 which are attached to the underside of the platform 30 adjacent the swinging extremity of the frame 12. The blocks 164 and 166 include aligned openings for longitudinally slidably receiving the forward actuator portion 160.

A pivot block 168 is fixed to the actuator portion 160 by any suitable means, such as by a set screw (not shown) extending through the block and into engagement with the portion 160. The pivot block 168 includes an upwardly opening bore 170 which pivotally receives a pivot pin 172 fixed to the swinging extremity of the frame 12. Although not apparent from the drawings, there is sufficient clearance between the pivot pin 172 and the bore 170 to permit travel of the pin 172 through an arcuate path without requiring any corresponding lateral movement of the actuator portion 160 from its usual longitudinal slidable axis.

The frame actuating means 156 also includes a connector block 174 mounted to the actuator portion 160 and secured thereto by a usual set screw 176.

The block 174 rigidly mounts a laterally extending rod 178 which carries a roller cam 180 at its end for location within the cam track 148, as best seen in FIGS. 14 and 15. With this arrangement, longitudinal or axial movement of the actuator portion 160 is adapted to swing the frame 12 between the woods position illustrated in FIG. 17 and the irons position illustrated in FIG. 18. The carrier members 18/20 are shown diagrammatically to indicate their orientation in the woods and irons positions, as a consquence of which the golf ball 16 will be placed upon the tee 22 or behind the tee 22 on top of the pedestal 140.

The frame actuating means 156 also includes pedal means for moving the actuator portion 160 longitudinally, the pedal means comprising forwardly and rearwardly extending pedal treads 182 and 184, respectively, as best seen in FIG. 16, which are mounted to the upper extremity of a generally vertically oriented lever 186. The lower extremity of the lever 186 is pivotally carried by a transverse pin 188 which extends through the vertical legs of a pair of right angular support brackets 190 which are secured to the underside of the platform 30. The rearward extremity of the actuator portion 158 is pivotally secured by a pin 182 just below the midportion of the lever 186. Depressing the pedal tread 182 carries the rearward extremity of the actuator portion 158 in an arcuate path forwardly and downwardly, which is transmitted by the pivot pin 162 to the actuator portion 160 as a longitudinal forward movement, swinging the frame 12 into the woods position of FIG. 17, and moving the cam 180 into the forward portion of the cam track 148 to thereby project the tee 22 into the woods position of FIG. 14. Conversely, depressing the pedal tread 184 has the effect of moving the frame 12 rearwardly to the irons position of FIG. 18, accompanied by movement of the cam 180 into the rearward portion of the cam track 148, which retracts the tee 22 into the irons position of FIG. 15.

With the foregoing arrangement, a golfer is able to maintain concentration in practicing his golf swing, merely tapping the switch 142 each time he wishes to place or tee up a fresh ball, the interaction of the components of the apparatus 10 assuring gripping of the ball prior to placement of the ball in a hitting station, and release of the ball prior to a repetition of the cycle, and location of the tee and ball in the proper position for a woods shot or an irons shot.

Various modifications and changes may be made with regarding to the foregoing detailed description without departing from the spirit of the invention.

I claim:

1. Golf ball teeing aparatus comprising:

a frame;

a ball receptacle adjacent said frame defining a loading station for receiving a ball;

an elongated carrier member having longitudinally spaced apart first and second stop means and a carrier extremity, said carrier member being pivotally carried by said frame for location of said carrier extremity alternately in said loading station and a hitting station;

an elongated gripper member having a gripper extremity and coupled to said carrier member for longitudinal movement relative to said carrier member between said first and second stop means to define, respectively, a gripping position in which said gripper extremity is extended for urging a ball in said loading station against said carrier extremity, and a release position in which said gripper extremity is retracted for releasing a ball in said hitting station, said gripper member being pivotable with said carrier member between said loading station and said hitting station; and drive means mounted to said frame and operative subsequent location of said carrier extremity in said loading station sequentially to move said gripper member into said gripping position and pivot said carrier member to locate said carrier extremity in said hitting station, said drive means being reversible subsequent location of said carrier extremity in said hitting station sequentially to move said gripper member into said release position and pivot said carrier member to locate said carrier extremity in said loading station.

2. Golf ball teeing apparatus according to claim 1 wherein said ball receptacle includes a stop for limiting travel of a ball out of said loading station, and wherein said ball receptacle includes lateral openings adjacent said stop, said carrier extremity and said gripper extremity having portions located on opposite sides of said stop and closing said lateral openings in said loading station whereby a ball may be gripped between said carrier extremity and said gripper extremity upon movement of said gripper extremity to said gripping position.

3. Golf ball teeing apparatus according to claim 1 wherein said gripper member comprises a rod and said carrier member is a cylindrical sleeve longitudinally slidably receiving said rod.

4. Golf ball teeing apparatus according to claim 3 wherein said gripper extremity constitutes an enlarged portion of said rod, and including a bracket attached to the extremity of said rod opposite said gripper extremity, the opposite ends of said carrier member constituting said first and second stop means engageable by said bracket and said gripper extremity to define said gripping position and said release position, respectively.

5. Golf ball teeing apparatus according to claim 1 and including a flap pivotally carried by said frame for movement between a closed position wherein it is adapted to cover a slot in a platform, and an open position uncovering said slot, said carrier and gripper extremities being pivotable out of said slot upon movement from said loading station to said hitting station.

6. Golf ball teeing apparatus according to claim 1 and including first switch means actuable by a golfer to operate said drive means for moving said carrier and gripper members from said loading station to said hitting station; second switch means actuable upon location of said carrier and gripper members in said hitting station to operate said drive means for moving said carrier and gripper members from said hitting station to said loading station; and third switch means actuable upon location of said carrier and gripper members in said loading station to render said drive means inoperable.

7. Golf ball teeing apparatus according to claim 6 wherein said drive means comprises a reversible electric motor electrically coupled to said first, second and third switch means.

8. Golf ball teeing apparatus according to claim 1 wherein said drive means comprises a rotatable driven member; a drive arm coupled at its opposite extremities between said driven member and the extremity of said gripper member opposite said gripper extremity for movement of said gripper member between said gripping and release positions; a crank arm fixed at one extremity to the extremity of said carrier member opposite said carrier extremity, and frictionally coupled at its other extremity to said drive arm for pivotal movement therewith; and friction means carried by said frame and operative upon said crank arm to constrain said crank arm against pivotal movement prior to engagement of one of said first and second stop means by said gripper member whereby pivotal movement of said carrier and gripper members is preceded by longitudinal movement of said gripper member relative to said carrier member.

9. Golf ball teeing apparatus according to claim 8 wherein said friction means comprises a coupling sleeve fixed to said crank arm, rotatably receiving said driven member, and having a friction pad rotatable therewith; and a friction clamp fixed to said frame and frictionally engaging said friction pad.

10. Golf ball teeing apparatus comprising;

a frame;

a ball receptacle adjacent said frame defining a loading station for receiving a ball;

an elongated cylindrical carrier member having an inner extremity and a carrier extremity defining first and second stop means, respectively;

an elongated gripper member having an inner extremity and a gripper extremity and longitudinally slidably carried by said carrier member between said first and second stop means to define, respectively, a gripping position in which said gripper extremity is extended for urging a ball in said loading station against said carrier extremity, and a release position in which said gripper extremity is retracted for releasing a ball in a hitting station;

a reversible drive motor;

a drive arm coupled at one extremity to said drive motor for pivotal movement in opposite directions, according to the direction of rotation of said motor, and pivotally attached at its opposite extremity to said pivot extremity of said gripper member for moving said gripper extremity between said gripping and release positions;

a crank arm fixed at one extremity to said pivot extremity of said carrier member, and pivotable in opposite directions for locating said carrier and gripper extremities alternately in said loading station and said hitting station; and coupling means coupling said drive arm and said crank arm for moving said carrier member from said loading and teeing stations upon engagement of said first and second stop means, respectively.

11. Golf ball teeing apparatus according to claim 10 and including friction means operative upon said crank arm and providing a frictional constraint against free pivotal movement of said crank arm.

12. Golf ball teeing apparatus according to claim 10 and including clutch means interposed between said drive motor and said drive arm and operative to slip upon location of said carrier and gripper extremities in one of said loading and hitting stations.

13. Golf ball teeing apparatus according to claim 10 and including first switch means actuable by a golfer to operate said drive means for moving said carrier and gripper members from said loading station to said hitting station; second switch means actuable upon location of said carrier and gripper members in said hitting station to operate said drive means for moving said carrier and gripper members from said hitting station to said loading station; and third switch means actuable upon location of said carrier and gripper members in said loading station to render said drive means inoperable.

14. Golf ball teeing apparatus according to claim 10 wherein said drive motor comprises a reversible electric motor electrically coupled to said first, second and third switch means.

15. Golf ball teeing apparatus comprising:

a tee;

a ball receptacle defining a loading station for receiving a ball;

an elongated frame adapted to be pivotally supported at its inner extremity for movement between a forward, woods position and a rearward, irons position, said frame pivotally supporting a carrier means actuable in said woods position to transfer a ball from said loading station onto said tee;

tee mounting means carrying said tee and pivotally supported for movement of said tee between a retracted position, out of possible contact with a golf ball, and a projected position in which said tee is located for receiving and supporting a golf ball, said tee mounting means including first camming means; and frame actuating means including an actuator pivotally supporting the outer extremity of said frame, a second camming means cooperative with said first camming means, and pedal means pivotable in one direction to move said actuator and thereby pivot said frame into said woods position, and oppositely pivotable to oppositely move said actuator and pivot said frame into said irons position, said first and second camming means cooperating to move said tee into said projected position upon movement of said frame into said woods position, and further cooperating to move said tee into said retracted position upon movement of said frame into said irons position.

16. Golf ball teeing apparatus according to claim 15 wherein said first camming means comprises an inclined cam track, and said second camming means comprises a cam roller.

17. Golf ball teeing apparatus according to claim 16 wherein said cam track is channel shape whereby said cam roller is adapted to fit within said cam track and ride upon the opposed legs of said channel shape cam track.

18. Golf ball teeing apparatus according to claim 15 wherein said actuator is movable along a longitudinal axis, and wherein said second camming means comprises a cam roller cooperative with said first camming means, and further comprises a laterally extending element fixed to said actuator at one extremity and rotatably mounting said cam roller at its opposite extremity.

19. Golf ball teeing apparatus according to claim 15 wherein said pedal means comprises a generally vertically oriented lever pivotally supported at its lower extremity and mounting pedal tread means at its upper extremity, and wherein said lever is pivotally coupled to said actuator whereby depression of said pedal tread in one direction moves said actuator to pivot said frame into said woods position, and depression of said pedal tread in the opposite direction moves said actuator to pivot said frame into said irons position.

20. Golf ball teeing apparatus according to claim 15 wherein said actuator mounts a pivot block for said pivotal support of said outer extremity of said frame, and including means for adjusting the location of said pivot block along the length of said actuator.

* * * * *